United States Patent [19]

Adams

[11] Patent Number: 4,694,763

[45] Date of Patent: Sep. 22, 1987

[54] SEWING MACHINE BED SLIDE RETENTION

[75] Inventor: Kenneth D. Adams, Madison, N.J.

[73] Assignee: SSMC Inc., Stamford, Conn.

[21] Appl. No.: 427,208

[22] Filed: Sep. 29, 1982

Related U.S. Application Data

[63] Continuation of Ser. No. 179,861, Aug. 20, 1980, abandoned.

[51] Int. Cl.[4] ..... D05B 73/12

[52] U.S. Cl. ..... 112/184; 112/260

[58] Field of Search ..... 112/184, 191, 228, 231, 112/258, 260

[56] References Cited

U.S. PATENT DOCUMENTS

| | | | |
|---|---|---|---|
| 423,112 | 3/1890 | Baker | 112/260 |
| 1,262,114 | 4/1918 | Smallbone | 112/260 |
| 1,360,357 | 11/1920 | Bauer | 112/260 |
| 1,457,449 | 6/1923 | Moffatt | 112/260 |
| 2,144,801 | 1/1939 | Hohmann | 112/184 X |
| 2,500,731 | 3/1950 | Zeier | 112/260 |
| 2,920,593 | 1/1960 | Johnson | 112/260 |
| 3,440,987 | 4/1969 | Coulombe | 112/260 |
| 3,530,812 | 9/1970 | Rouha | 112/258 |
| 3,545,393 | 12/1970 | Meier | 112/260 |
| 4,079,684 | 3/1978 | Thomson | 112/258 X |
| 4,263,859 | 4/1981 | Johnson | 112/184 |
| 4,292,906 | 10/1981 | Johnson | 112/184 |

FOREIGN PATENT DOCUMENTS

| | | | |
|---|---|---|---|
| 43-7769 | 4/1968 | Japan . | |
| 43-7771 | 4/1968 | Japan . | |
| 79512 | 3/1932 | Sweden . | |
| 271628 | 2/1951 | Switzerland | 112/260 |
| 352551 | 4/1961 | Switzerland | 112/260 |

*Primary Examiner*—Wm. Carter Reynolds
*Attorney, Agent, or Firm*—Robert E. Smith

[57] ABSTRACT

A bed slide for a sewing machine having a frame fabricated of a synthetic resin material, the bed slide extending beyond the throat plate on both sides thereof, and thereby beyond the cavity accommodating the loop-taker, and two embodiments of devices attachable to the synthetic resin material spaced from the cavity for slidably retaining the bed slide therein. The first embodiment, a headed stud having a transverse slot therein for receiving a turned back edge of the bed slide is retained in an aperture molded in the synthetic resin material, with a resilient member exerting a pull on the stud for imparting a drag to the bed slide and retaining the same to the bed. In the second embodiment, a Z-shaped member has its lower bar fastened to the sewing machine bed and its upper bar inserted between the bed slide and a turned back end thereof. A portion of the upper bar is bent downwardly to provide for a drag resisting free motion of the bed slide.

2 Claims, 5 Drawing Figures

SEWING MACHINE BED SLIDE RETENTION

This application is a continuation, of application Ser. No. 179,861, filed Aug. 20, 1980 now abandoned.

DESCRIPTION

BACKGROUND OF THE INVENTION

This invention is in the field of sewing machines; more particularly, this invention is concerned with means for retaining a bed slide in the frame of a sewing machine molded of a synthetic resin material.

In the prior art sewing machines, the preferred material has been metal such as cast iron or, more recently, aluminum for its lightness. When it becomes necessary to retain parts or accessories in position in the frame of such a sewing machine it is relatively easy to drill and tap a hole therein and provide for attachment by means of a machine screw.

However, in an effort to find more acceptable lower cost and lighter weight materials, many appliances are being fabricated utilizing synthetic resin materials. The use of the synthetic materials has required the development of new techniques for assembling components to these materials. For example, metal inserts can be molded in place, which inserts may carry internal or external threads for attachment purposes. However, in certain situations, these techniques are not readily applied and further efforts may be required to devise ways of retaining components.

Specifically, heretofore sewing machine bed plates could be slidably retained by cutting a dovetail in a sewing machine bed fabricated of a metallic material and sliding in a bed slide having surfaces correspondingly dovetailed. However, one of the advantages accruing to the use of a synthetic plastic material lies in its use in an as molded state without recourse to machining operations. Also, the synthetic materials are not as amenable to machining as metallic materials.

What is required is some means for retaining a bed side slidably in the bed of a sewing machine having a frame made of a synthetic resin material so that the full advantages of this material may be obtained.

SUMMARY OF THE INVENTION

The above requirement is attained in a sewing machine in which the bed slide is made wider transverse to the direction of slidable motion over the cavity accommodating the loop taker which it spans and, accordingly, wider than the throat plate which it abuts. Thereby, resilient retaining members may be secured in bed a satisfactory distance from the looptaker cavity by techniques commonly applicable with synthetic resin materials. In a first embodiment, the bed slide may have the sides thereof extending beyond the throat plate doubled back upon itself with the edge thereof received in a transverse slot in the head of a stud. A hole may be cored in the bed, spaced from the looptaker cavity, to receive the stud, the hole opening up to receive a compression spring surrounding the stud, which compression spring is retained on the stud by a retaining ring on the end thereof.

In a second embodiment, a similar bed slide may be used in a cavity having two steps to the work supporting surface, the first step accommodating the bed slide and the second step having affixed thereto a Z clip having a downturned ear and two apertures on the upper bar thereof and an upturned ear and two apertures on the lower bar thereof. The Z clips have their upper bars extending above the turned back edge of the bed slide, providing for guidance and retention thereof. The Z clip is designed such that one configuration may be used on either side of the bed slide, the lower bar on one side becoming the upper bar on the other side by flipping the Z clip endwise.

BRIEF DESCRIPTION OF THE DRAWINGS

The foregoing will be more readily apparent upon reading the following description in conjunction with the drawings in which:

Referring now to FIG. 1 there is shown a portion of a sewing machine bed 10, which is molded from a synthetic resin material and on which is supported a throat plate 12 and a bed slide 22 shown in the abutting position to the throat plate. The throat plate 12 includes the usual slots 14 for a sewing machine feed dog 15 part of a sewing machine feed system (not shown) utilized for feeding a work material through a sewing machine. The throat plate is positioned on the bed on a pin 16 and headed stud 18, which headed stud may be elevated against the urgings of a compression spring 19 (see FIG. 3) so as to lift the throat plate 12 from the bed 10. The throat plate is also fashioned with a needle orifice 20 so as to permit passage of sewing needle 21 shown in FIG. 2. Also shown in phantom is the outline of a cavity 24 in the bed 10, the cavity receiving the sewing instrumentalities which cooperate with the sewing needle 21 in the formation of stitches.

Referring now to FIG. 2, there is shown the usual sewing machine head 26 supported above the bed 10, the sewing machine head supporting for endwise reciprocation the needle bar 28 terminating in the sewing needle 21 and the presser bar 30 terminating in a presser foot 31. The presser foot 31 operates in opposition to the feed dog 15 which would extend through the slot 14 in the throat plate 12 to feed a work material through the sewing machine. The needle 21 cooperates with a looptaker 32 in the formation of stitches, the looptaker 32 being accommodated in the cavity 24 beneath the throat plate 12 and bed slide 22. Access to the looptaker 32 is provided by the bed slide 22 which may be slipped out of the way in order to replace, for example, a bobbin (not shown) carrying a lower thread for stitching the work material. In FIG. 2 it can be seen that the bed slide 22 is fashioned on the sides thereof with a doubled back end 34 spaced from the top surface of the bed slide. The end 34 of the bed slide 22 is spaced from the cavity 24 by a substantial amount which causes the bed slide to extend beyond both sides of the throat plate 12. Thus, apertures 36 may be molded, or machined, into the bed 10 with counterbores 38 on both sides thereof. These apertures 36, with their counterbores 38, are spaced a sufficient distance from the cavity 24 by enlarging the bed slide 22 so as to avoid any adverse effects on the bed 10 by molding apertures too close together. A stud 40 having a head 41 with a transverse slot 42, extends through the aperture 36, the head fitting into one counterbore 38 and a compression spring 44 encircling the stud fitting into the other counterbore. The compression spring 44 is retained to the stud 40 by a retaining ring 46, thereby also retaining the stud to the bed 10. The end 34 of the bed slide 22 fits into the transverse slot 42 in the head 41 of the stud 40 and is slidable therein. Thus, the bed slide 22 is resiliently retained against the bed 10 by the compression springs 44 and may slide away to expose the looptaker 32 in the cavity 24 by having the ends 34 thereof travel within the transverse slots 42 of the studs 40. By supporting the studs 40 in apertures 36 and counterbores 38 spaced from the cavity 24, molding or machining difficulties are avoided and new, more economical materials may be utilized for the bed 10.

Referring now to FIG. 3, a second embodiment is disclosed utilizing a retaining member 50 which may be turned end for end to use on either side of the bed slide 22. In FIG. 3 the throat plate 12 is shown along with headed stud 18 which may extend therethrough, which stud is urged downwardly by retaining spring 19 which acts between the bed 10 and retaining ring 63 to draw the stud down against the throat plate 12. The retaining members 50, which preferrably are fashioned from a resilient sheet metal material, are retained in the sewing machine bed 10 by screws 60 (see also FIGS. 4 and 5). The retaining member 50 is formed with a riser or leg 51 separating two lands 52, the lands having opposite ends 53 inclined towards the riser. The upper land 52 overlies the end 34 of the bed slide 22 for guidance thereof and the end 53 thereof provides a frictional drag to motion of the bed slide. A pair of holes 58 pass through each land 52 of the retaining member 50 for a total of 4 holes per retaining member. It will be apparent that, by turning the retaining member 50 end for end, a retaining member might be used on either the left or the right-hand side of the bed slide 22. Screws 60 passing through the holes 58 in the lower land 52 extend into the sewing machine bed 10 and are retained there.

In FIG. 3, there is shown a portion of a sewing machine bed 10 having a work supporting surface 66 within which is situated the cavity 24 for receiving the looptaker 32. The surface 66 lets down to the cavity 24 in two stages, the first step 70 being the step on which the throat plate 12 and the bed slide 22 is received. The next adjacent step 72 is the step to which the retaining member 50 is attached by means of screws 60 retained in holes or apertures 61 which may be molded into the bed 10. The details of this attachment and the relationship of the retaining member 50 to the bed slide 22 is apparent in FIGS. 4 and 5. Thus, it is seen that the forward downturned end 53 of the upper land 52 impinges upon the end 34 of the bed slide 22 providing resistance to sliding of the bed slide which will maintain the bed slide in a selected position. The opposite upturned end 53 of the retaining member 50, i.e., the ends adjacent the screw 60, are ineffective, becoming effective only if used on the opposite side of the bed slide.

Figure 1:
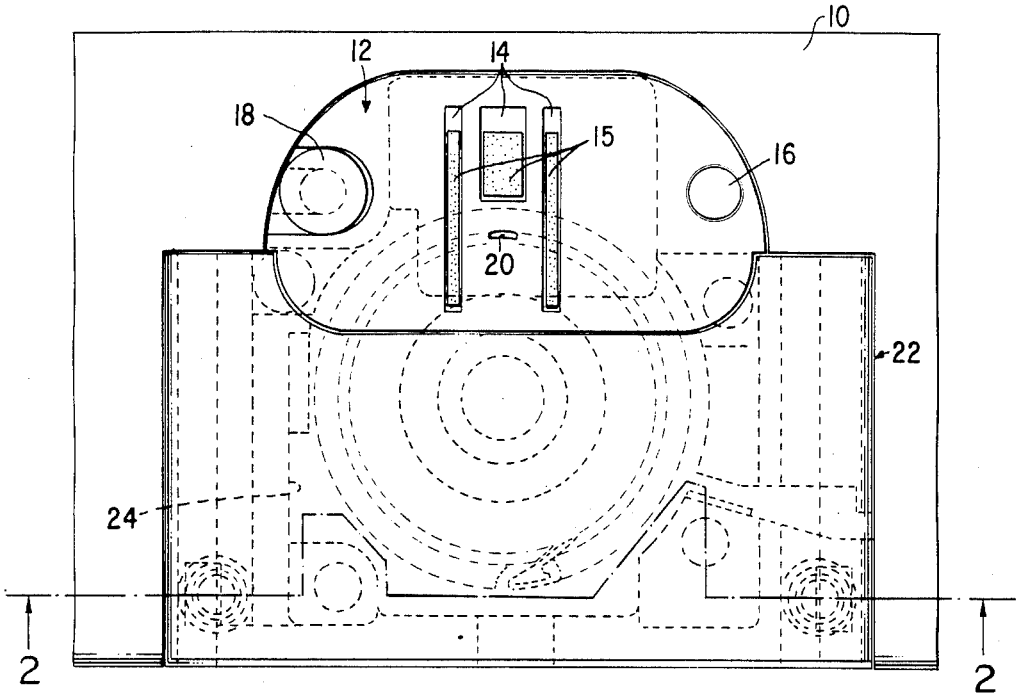
FIG. 1 is a plan view of a portion of the work supporting bed of a sewing machine showing the throat plate and improved bed slide thereof.
Figure 2:
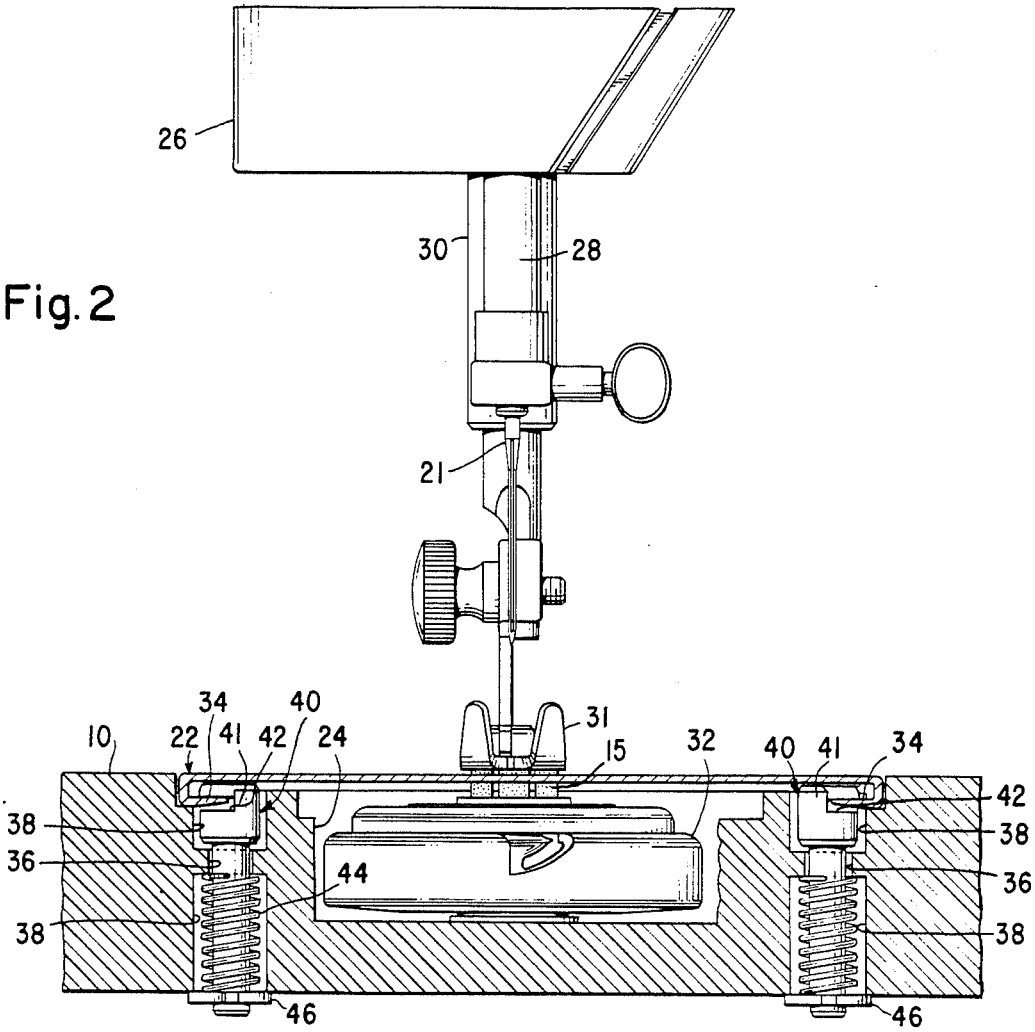
FIG. 2 is a front elevation partially in section of the sewing machine bed shown in FIG. 1.
Figure 3:
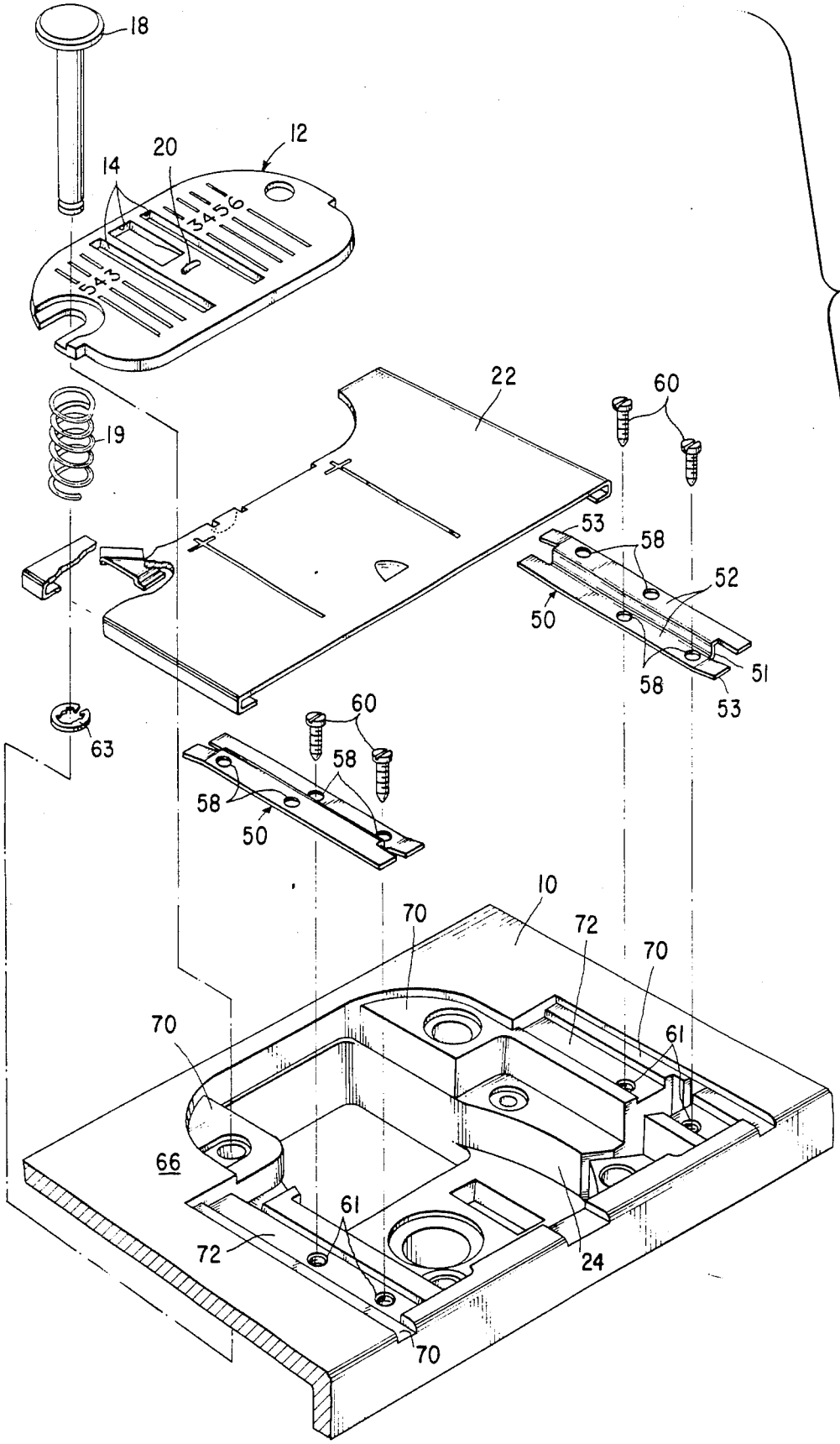
FIG. 3 is an exploded isometric of a second embodiment of a bed slide having different resilient retaining members for retaining the throat plate.
Figure 4:
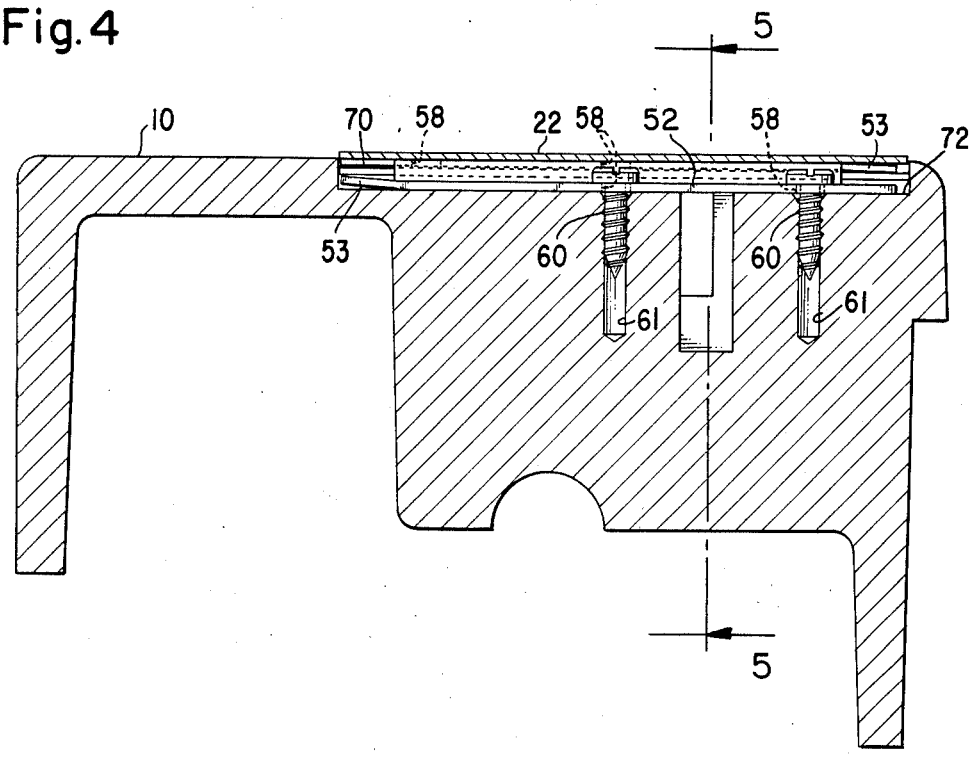
FIG. 4 is a view partly in section of the bed, slide and retaining member shown in FIG. 3 taken along the line 4—4 of FIG. 5 and along the length of the retaining member to show the attachment thereof to the bed; and, FIG. 5 is a transverse cross sectional view partly in section of the bed, slide and retaining member shown in FIGS. 3 and 4 and taken along the line 5—5 of FIG. 4, indicating the relationship of the retaining member to the bed.
Figure 5:
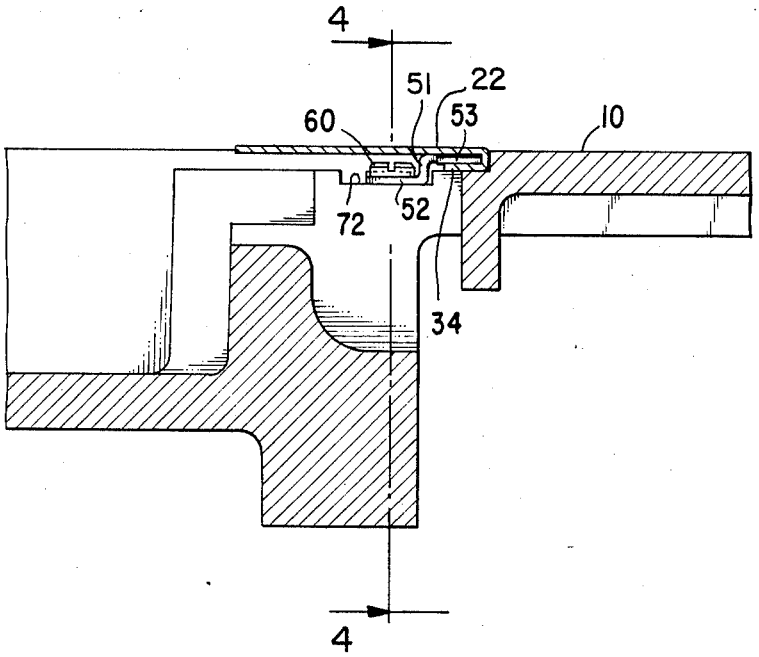

I claim:

1. A sewing machine comprising a frame including a head and a work supporting bed, said head supporting therein an endwise reciprocating sewing needle, said work supporting bed being fashioned of molded synthetic resin material and having a cavity therein for a sewing machine loop taker for cooperation with said sewing needle in the formation of stitches, a throat plate spanning said cavity, said throat plate having an orifice for passage of said sewing needle to said loop taker, a bed slide adjacent said throat plate, said, bed slide spanning said cavity and extending beyond said throat plate on both sides of said throat plate, and means adjacent said cavity on opposite sides thereof for slidably holding said bed slide to said bed for selective movement from a position abutting said throat plate to a position spaced from said throat plate to expose said sewing machine loop taker, said means including at least a pair of apertures in said work supporting bed, one each of said apertures on opposite sides of and spaced from said cavity a distance amenable to good molding practice for the synthetic resin material, said bed slide further comprising ends beyond both sides of said throat plate doubled back under said slide and spaced therefrom so that the ends thereof lie beyond both sides of said throat plate aligned with and directed towards each other, said holding means comprising a pair of first steps in said work supporting bed one each beyond both sides of said throat plate for slidably receiving said bed slide for selective positioning abutting said throat plate and spaced thereform, a pair of second steps on both sides of said cavity one adjacent each of said first steps and spaced from said bed slide a pair of sheet metal Z shaped members, each having a lower bar, an upper bar, and a leg joining said lower and said upper bars, said lower bars thereof supported one on each of said second steps and said upper bars thereof adapted to extend one on each end of said bed slide between said bed slide and said doubled back ends, and means for retaining said lower bars on said second steps.

2. A sewing machine as claimed in claim 1 wherein each of said Z shaped members is fashioned from a resilient material and each further comprises oppositely directed free ends on said lower and upper bars extending beyond and inclined toward said leg, whereby one of said inclined ends impinges on one of said doubled back ends of said bed slide imparting some resistance to movement thereof and whereby a single member may be used on either side of the bed slide by a 180° rotation thereof to utilize the opposite end.

* * * * *